US012616264B1

(12) United States Patent
Abood

(10) Patent No.: US 12,616,264 B1
(45) Date of Patent: May 5, 2026

(54) WATERCRAFT AND WATER SPORTS HYPOTHERMIA CAP

(71) Applicant: Equalizer Technology, LLC, Rock River, OH (US)

(72) Inventor: David G. Abood, Rocky River, OH (US)

( * ) Notice: Subject to any disclaimer, the term of this patent is extended or adjusted under 35 U.S.C. 154(b) by 127 days.

(21) Appl. No.: 18/599,726

(22) Filed: Mar. 8, 2024

Related U.S. Application Data

(63) Continuation-in-part of application No. 15/872,095, filed on Jan. 16, 2018, now Pat. No. 11,528,950, and a continuation-in-part of application No. 14/850,940, filed on Sep. 10, 2015, now abandoned, and a continuation-in-part of application No. 13/692,060, filed on Dec. 3, 2012, now Pat. No. 11,545,052, which is a continuation-in-part of application No. 12/649,887, filed on Dec. 30, 2009, now Pat. No. 10,219,568.

(60) Provisional application No. 62/617,695, filed on Jan. 16, 2018, provisional application No. 62/447,424, filed on Jan. 17, 2017, provisional application No. 62/048,684, filed on Sep. 10, 2014.

(51) Int. Cl.
*A42B 1/00* (2021.01)
*A42B 1/12* (2006.01)

(52) U.S. Cl.
CPC ..... *A42B 1/12* (2013.01)

(58) Field of Classification Search
CPC ..... A42B 1/12; A42B 1/00; A42B 3/06
See application file for complete search history.

(56) References Cited

U.S. PATENT DOCUMENTS 1,501,409 A * 7/1924 Logan ..... A42B 1/12 D2/867
1,798,024 A * 3/1931 Mcbride ..... A42B 1/12 2/68
2,105,956 A * 1/1938 Schnaittacher ..... A42B 1/12 2/12
2,193,271 A * 3/1940 Cowherd ..... A42B 1/049 D24/189
2,417,323 A * 3/1947 Richards ..... A42B 1/12 D2/867
2,549,376 A * 4/1951 Hurt ..... A42B 1/12 D2/867
2,644,949 A * 7/1953 Greenberg ..... A42B 1/0189 2/172
2,664,569 A * 1/1954 Andrews ..... A42B 1/12 2/68

(Continued)

FOREIGN PATENT DOCUMENTS

DE 202016005862 U1 * 11/2016 ..... A42B 1/12

*Primary Examiner* — Richale L Quinn
(74) *Attorney, Agent, or Firm* — Gugliotta & Gugliotta LPA

(57) ABSTRACT

A hypothermia insulative cap is provided enhanced with a GPS-enabled LED strip for emergencies, constructed from dual-layer nylon and neoprene with advanced seam technologies for durability and comfort. It features a unique technology chassis for waterproofing essential electronics, a battery-activated GPS and LED for increased visibility, and a protective brow visor for comfort and protection. This cap is designed to maintain body temperature during waterborne rescues, offering increased visibility to rescuers and compatibility with conventional life vests, without impeding the function of either device.

13 Claims, 10 Drawing Sheets

(56) References Cited

U.S. PATENT DOCUMENTS 2,726,398 A * 12/1955 Cooper ..... A42B 1/12 2/174
2,885,683 A * 5/1959 Lipkin ..... A42B 1/0186 2/172
3,104,644 A * 9/1963 Burton ..... G09F 17/00 116/173
3,106,184 A * 10/1963 Shea ..... B63B 32/70 441/89
3,108,283 A * 10/1963 Gasaway ..... A42B 1/12 2/68
3,113,319 A * 12/1963 Vail ..... A42B 1/12 2/68
3,274,612 A * 9/1966 Merriam ..... A42B 3/00 2/421
3,296,582 A * 1/1967 Ide ..... G10K 11/002 181/175
3,321,772 A * 5/1967 Arps ..... A42B 1/12 2/68
3,321,774 A * 5/1967 Tames ..... A42B 1/012 2/181
3,329,970 A * 7/1967 Damsz ..... A42B 1/12 2/68
3,454,962 A * 7/1969 Hind ..... A42B 1/12 2/209
3,503,076 A * 3/1970 Marks ..... A42B 1/12 2/68
3,512,181 A * 5/1970 Osborne ..... A42B 1/012 D2/881
3,594,815 A * 7/1971 Reese ..... A42B 1/0188 2/909
3,793,110 A * 2/1974 Saunders ..... B29C 66/004 156/289
3,872,516 A * 3/1975 Bird ..... A42B 1/045 2/202
3,953,892 A * 5/1976 Kennedy ..... A42B 1/12 2/425
3,978,527 A * 9/1976 Bednar ..... A42B 1/12 2/68
3,979,777 A * 9/1976 Gregg ..... A63B 33/00 2/68
4,061,898 A * 12/1977 Murray ..... A42B 1/008 219/549
4,279,039 A * 7/1981 Drew ..... A42B 1/12 D16/311
4,281,417 A * 8/1981 Valentine ..... A42B 1/12 2/68
4,552,149 A * 11/1985 Tatsuki ..... A61F 7/10 607/110
4,612,672 A * 9/1986 Schrack ..... A42B 1/12 2/908
5,046,193 A * 9/1991 Foresman ..... A42B 7/00 2/200.2
5,197,292 A * 3/1993 McPherson ..... A42C 5/04 62/530
5,351,343 A * 10/1994 Harbison ..... A42B 1/0188 2/172
5,455,970 A * 10/1995 Vance ..... A42B 1/201 2/171.04
5,557,807 A * 9/1996 Hujar ..... A42B 1/0187 2/209.13
5,765,229 A * 6/1998 McLeod ..... A42B 1/0186 2/200.1
5,850,636 A * 12/1998 Reuven ..... A42B 1/008 2/200.1
5,887,285 A * 3/1999 McCormick ..... A42C 5/04 2/171.1
6,014,776 A * 1/2000 DeVinzio ..... A42B 1/041 2/172
6,253,378 B1 * 7/2001 Nealy ..... A42B 1/12 2/68
6,467,096 B1 * 10/2002 Coluccio ..... A42B 1/22 2/195.2
D473,365 S * 4/2003 Bias ..... D2/867
6,557,179 B1 * 5/2003 Reuven ..... A42B 1/008 2/209
6,966,068 B2 * 11/2005 Johnson ..... A42B 1/12 2/200.2
7,043,761 B2 * 5/2006 Epling ..... A42C 5/04 2/200.1
D584,000 S * 12/2008 Saluan ..... D29/106
7,930,768 B1 * 4/2011 Tyler ..... A42B 1/041 2/205
8,262,601 B2 * 9/2012 Cumming ..... A61F 13/12 602/14
8,613,114 B1 * 12/2013 Olivares Velasco ..... A41D 31/065 2/171.1
8,769,719 B2 * 7/2014 Portas ..... A42B 1/12 2/68
D714,666 S * 10/2014 Abood ..... D10/57
8,850,616 B1 * 10/2014 Hoover ..... A41D 31/125 2/170
9,086,286 B2 * 7/2015 Long ..... A63B 71/0622
10,219,568 B1 * 3/2019 Saluan ..... A42B 1/012
10,721,987 B2 * 7/2020 Lowe ..... A42B 3/064
10,869,516 B2 * 12/2020 Sokoloff ..... A42B 1/12
11,545,052 B1 * 1/2023 Abood ..... A42B 1/012
11,596,193 B1 * 3/2023 Abood ..... A42B 1/242
12,048,342 B2 * 7/2024 Bonhomme ..... A42B 1/12
12,226,230 B1 * 2/2025 Abood ..... A61B 5/7475
2005/0034215 A1 * 2/2005 Harrison ..... A42C 5/04 2/207
2005/0183182 A1 * 8/2005 Keenan ..... A61B 90/04 2/114
2007/0000024 A1 * 1/2007 Kozul ..... A42B 1/041 2/171
2007/0157358 A1 * 7/2007 Sharon ..... G09F 3/02 2/69
2010/0024091 A1 * 2/2010 Mehtab ..... A42B 1/206 2/244
2010/0037366 A1 * 2/2010 Panicali ..... A42B 1/008 2/209.13
2011/0010823 A1 * 1/2011 Horgan ..... A42B 1/041 2/171
2011/0094012 A1 * 4/2011 Toth ..... A42B 3/121 62/530
2011/0113533 A1 * 5/2011 Guillen ..... A63B 71/10 2/411
2012/0204306 A1 * 8/2012 Fierro ..... A42B 1/12 2/68
2014/0026284 A1 * 1/2014 Yates ..... A63B 33/00 2/67
2014/0338099 A1 * 11/2014 Marscellas ..... A42B 1/012 2/209.13
2015/0063777 A1 * 3/2015 Letke ..... A42B 1/245 386/224
2015/0157077 A1 * 6/2015 Stricker, Jr. ..... A42B 1/08 2/414
2015/0289048 A1 * 10/2015 Schermerhorn ..... A63B 33/004 381/376
2015/0335086 A1 * 11/2015 Murphy ..... A42B 1/041 2/171
2018/0027912 A1 * 2/2018 Borrás Esteve ..... A42B 1/12
2018/0220962 A1 * 8/2018 Palley ..... A61B 5/1116
2019/0029354 A1 * 1/2019 Cecchi ..... A63B 33/00
2020/0288804 A1 * 9/2020 Westbrook ..... A42B 7/00
2020/0391083 A1 * 12/2020 Vega ..... A63B 33/00
2021/0361014 A1 * 11/2021 Bono ..... A42B 1/225
2021/0401101 A1 * 12/2021 Miller ..... A42B 1/12
2022/0142280 A1 * 5/2022 Samma ..... A42B 1/22
2022/0386752 A1 * 12/2022 Johnson ..... B32B 25/12
2022/0414416 A1 * 12/2022 O'Driscoll ..... H04L 67/12
2023/0017021 A1 * 1/2023 Nelson ..... A61N 5/0617
2024/0058653 A1 * 2/2024 Williams ..... A42B 1/12
2025/0289531 A1 * 9/2025 Huynh ..... B63B 22/20

* cited by examiner

WATERCRAFT AND WATER SPORTS HYPOTHERMIA CAP

BACKGROUND OF THE INVENTION

1. Field of the Invention

The invention relates generally to water safety gear and, more specifically, to a hypothermia prevention cap designed to enhance thermal insulation and visibility for individuals in aquatic environments, incorporating advanced materials, integrated technology, and ergonomic design for improved rescue outcomes.

2. Description of the Related Art

Current laws state that for one operating a boat, canoe or kayak of any length, a U.S. Coast Guard-approved life jacket must be available for each person on board. If these life jackets are stored, they should be readily accessible. Additionally, children under 13 years of age must wear a properly fitted, U.S. Coast Guard-approved life jacket while underway in such a vessel. Laws also state that any person on board a personal watercraft (such as, for example, a Jet Ski® brand name of a personal watercraft manufactured by Kawasaki), or any person being towed behind a vessel (as in water skiing or knee-boarding) also must wear a U.S. Coast Guard-approved life jacket.

However, there currently is no product currently available on the market that can be used in conjunction with a life vest that can help maintain normothermia and reduce the deadly risks of hypothermia after a person has been in the water for a period of time. Consequently, a need exists for a safety systems, devices and methods for providing comfort and care to any person who is stranded in the water from a boating, sport/personal watercraft, cruise ship, airplane or helicopter accident and other situation where a victim finds themselves left stranded in the open water.

SUMMARY OF THE INVENTION

The present invention aims to provide a hypothermia and shock head covering that enhances comfort and care for individuals stranded in the water due to boating, sport/personal watercraft, cruise ship, airplane, or helicopter accidents, among other scenarios. This invention integrates advanced materials and technology to improve safety and visibility during rescue operations.

It is an object of the present invention to reduce the risks of hypothermia or circulatory shock related to water accidents for the passengers or operators of boats, canoes, or kayaks.

Another object of the present invention is to equip rescue personnel with a more effective visual target or marker to assist in identifying or locating individuals stranded in open water.

Furthermore, this invention is designed to work in conjunction with existing U.S. Coast Guard-approved life jackets.

According to a preferred embodiment, the invention introduces a watercraft and water sports hypothermia cap. This cap comprises a main panel, a central head panel, and a chin panel, all constructed from an outer layer of nylon and an inner layer of neoprene, 2.5 mm thick, aimed at optimizing insulation and comfort. The cap's design minimizes exposure to fibrous materials, thereby reducing habitats for bacterial growth, and incorporates a visual target or beacon to aid in locating the wearer by rescue personnel.

To ensure a secure and comfortable fit, all main seams are constructed with flatlock stitching and spot glue at the seam ends to prevent unraveling. Additionally, 5×3 mm holes are punched over the ear positions to balance insulation with the need for hearing. External seams are secured with a two-thread blindstitch, and the edges around the face and neck are finished with Lycra binding attached via zigzag stitching for enhanced durability and fit.

A novel GPS version of the cap includes an LED strip along the seams of the central head panel, which lights up to improve visibility when the cap is activated in emergencies. This feature is powered by a battery activator pull, further enhancing the cap's utility in search and rescue operations.

The electronics, including sensors and Bluetooth connectivity, are housed within a waterproof case integrated into the cap. This ensures the functionality of the GPS and LED features even in wet conditions.

An added brow visor provides protection from water and sunlight, improving the wearer's comfort and visibility. The visor and the technology chassis, a molded frame containing all the technological components, are made from TPU rubber. This material choice ensures flexibility for manufacturing processes and durability to protect against water damage. The frame seam allowance is meticulously designed to follow the contour of the cranium, with a visor seam allowance that ensures secure attachment.

The cap extends over a significant portion of the forehead, ears, and behind the head to the top of the cervical spine, with the innovative design elements ensuring minimal airflow between the cap material and the user's head. This design effectively prevents large air gaps, thus maintaining the user's head temperature within a safe range.

The incorporation of a chin strap ensures the cap's secure placement on the user's head, with attachment mechanisms designed for easy adjustment and a snug fit.

It is a final object of the present invention to provide all of the advantages that the foregoing objects entail.

BRIEF DESCRIPTION OF THE DRAWINGS

The advantages and the features of the present invention will become better understood with reference to the following more detailed description and the claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
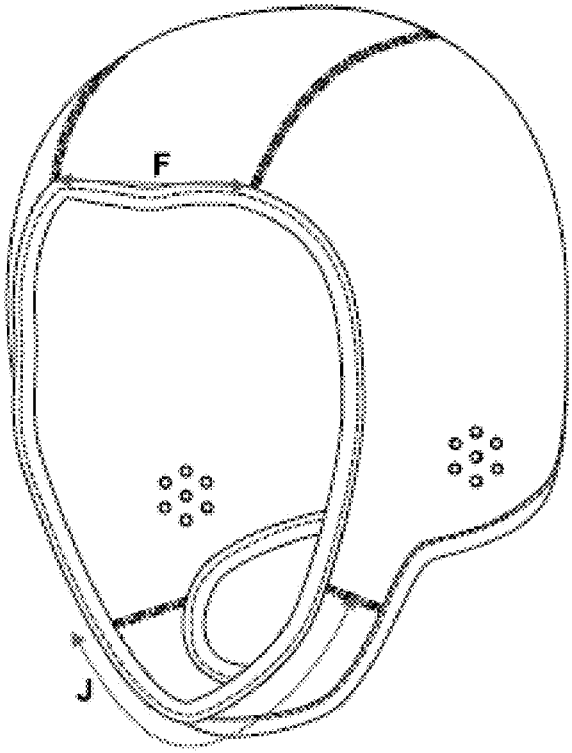
FIG. 1 is a front perspective view of a watercraft and water sports hypothermia and identification cap according to a preferred embodiment of the present invention shown being donned by a user.
Figure 2:
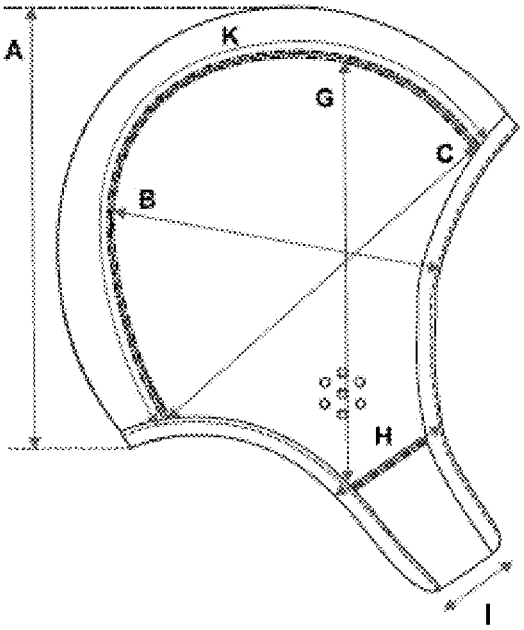
FIG. 2 is a perspective view of the cap itself.
Figure 3:
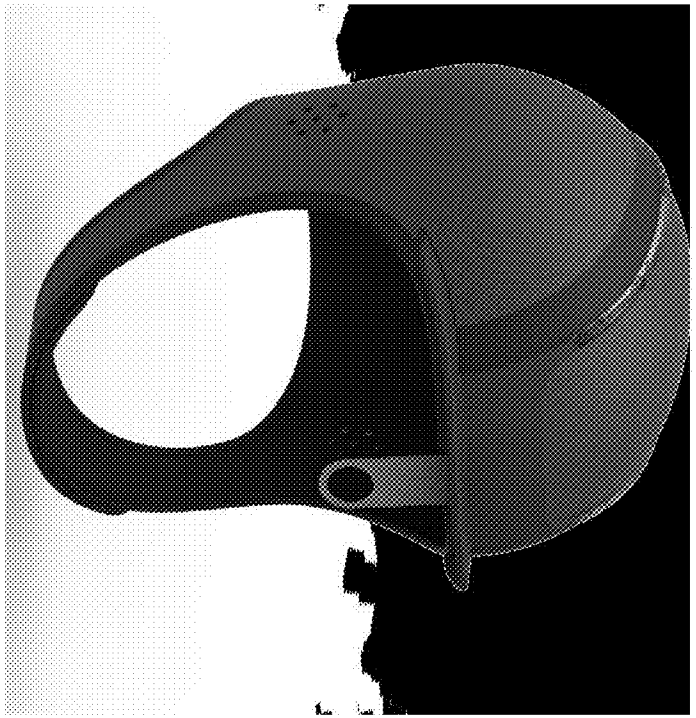
FIG. 3 is a front elevational view thereof.
Figure 4:
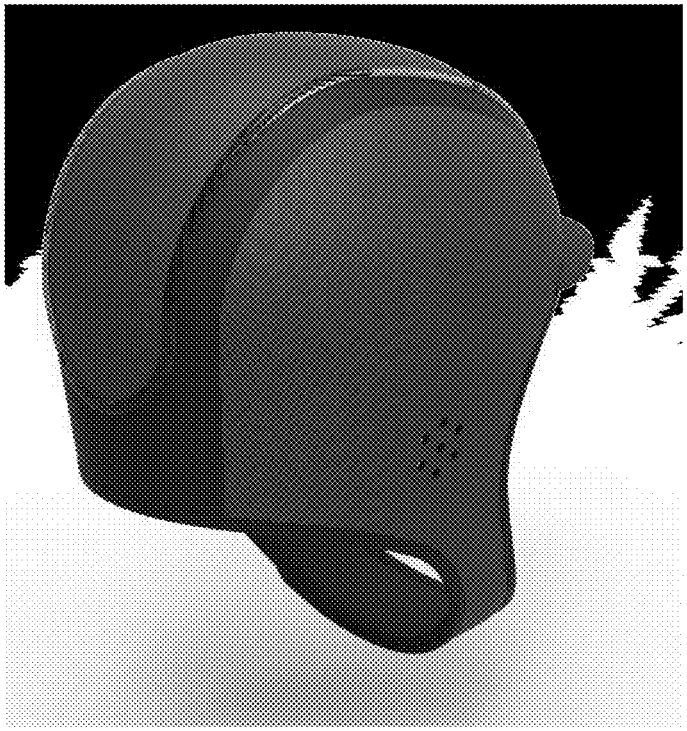
FIG. 4 is a left side elevational view thereof, the right-side elevational view being a mirror image.
Figure 5:
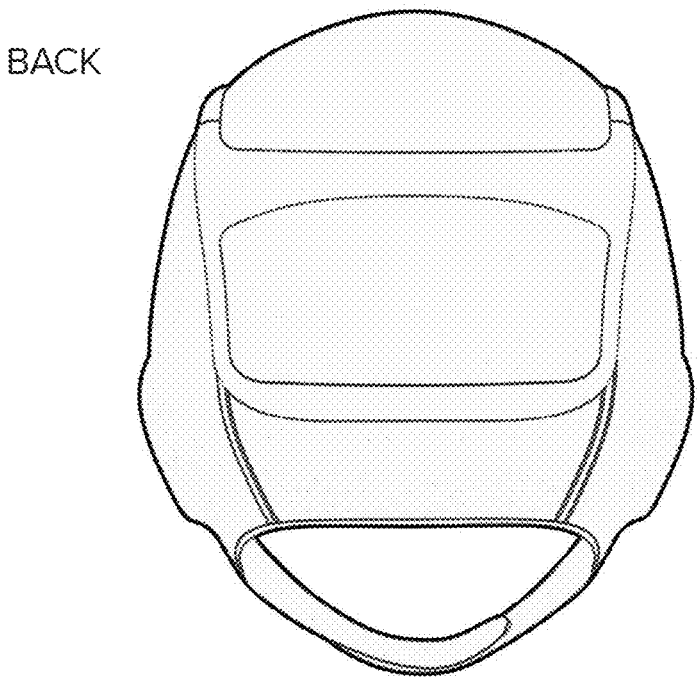
FIG. 5 is a rear elevational view thereof.

Referring now to the figures, where like references depict like elements, a covering unit, generally noted as 10, is shown for covering the head of a watercraft passenger or water sports participant. The covering unit 10, as depicted in FIG. 1-2 for the main embodiment, covers a substantial portion of the head 70. It forms a multi-part shell component featuring a main panel, central head panel, and chin panel constructed from an outer layer of nylon and an inner layer of neoprene, 2.5 mm thick, designed for closely fitting the contours of a user's head to prevent open air space between the head and the inner surface. The shell component further has an outer surface 14, forming an opening 16 circumscribed by a gripping lower edge 18. This gripping lower edge 18 serves as a means to secure the covering unit to a wearer's head, preventing displacement during use.

All main seams of the covering unit 10 are executed with flatlock construction and spot glue applied to the outside of seam ends for enhanced durability. Over the ear positions, 5×3 mm holes are punched to facilitate hearing without compromising thermal insulation. All external seams are reinforced with a two-thread blindstitch, and the edges around the face and neck are finished with Lycra binding attached using zigzag stitching for a secure and comfortable fit.

The covering unit 10 is intended to be used in conjunction with a conventional U.S. Coast Guard-approved life jacket (not shown). The design ensures that, when used with such a life jacket, the user's head-normally the only part of the body exposed above the water's surface-remains insulated and visible. A visual target or beacon 21, affixed along the crown from front to back, is provided by a light-reflective material or an active lighting element, enhancing visibility in both night conditions and daylight, aiding search and rescue teams in locating victims.

Figure 6:
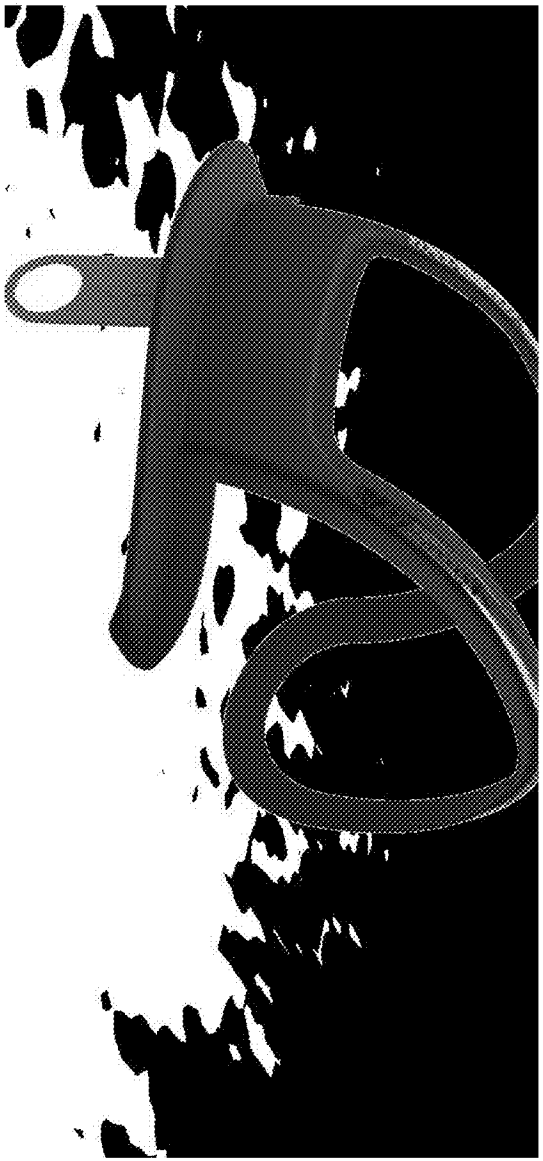
FIG. 6 is a front perspective view of a technology chassis for use therewith.
Figure 7:
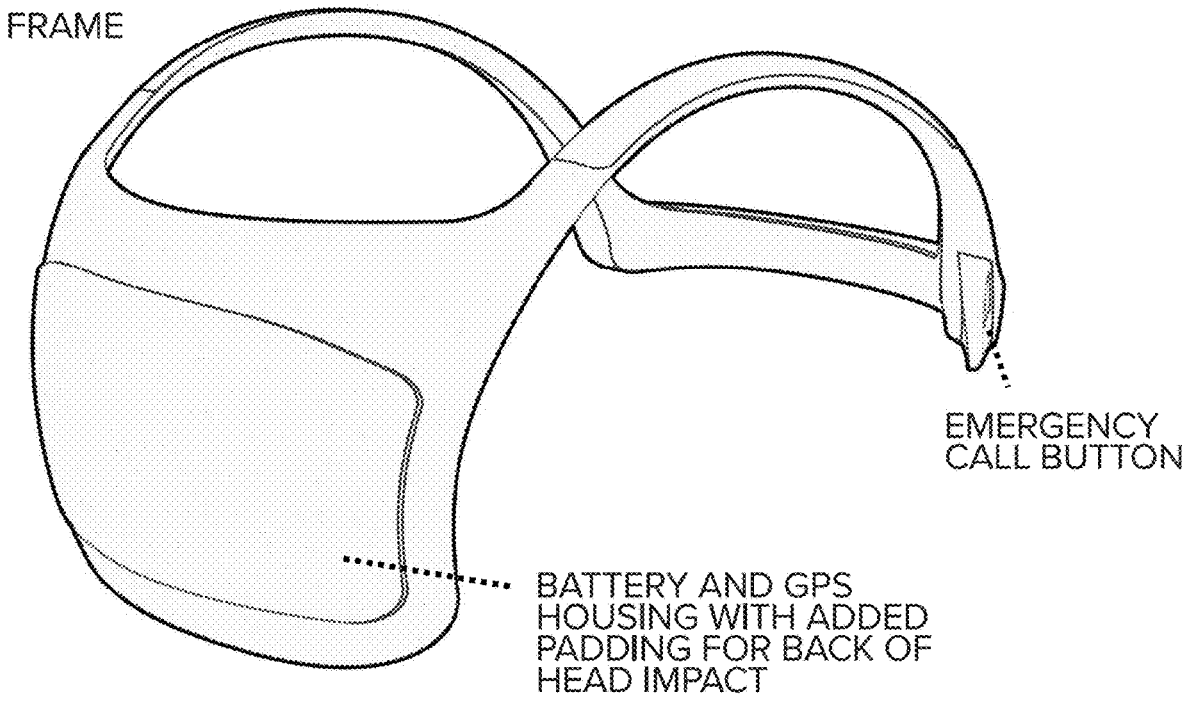
FIG. 7 is a rear perspective view thereof.
Figure 8:
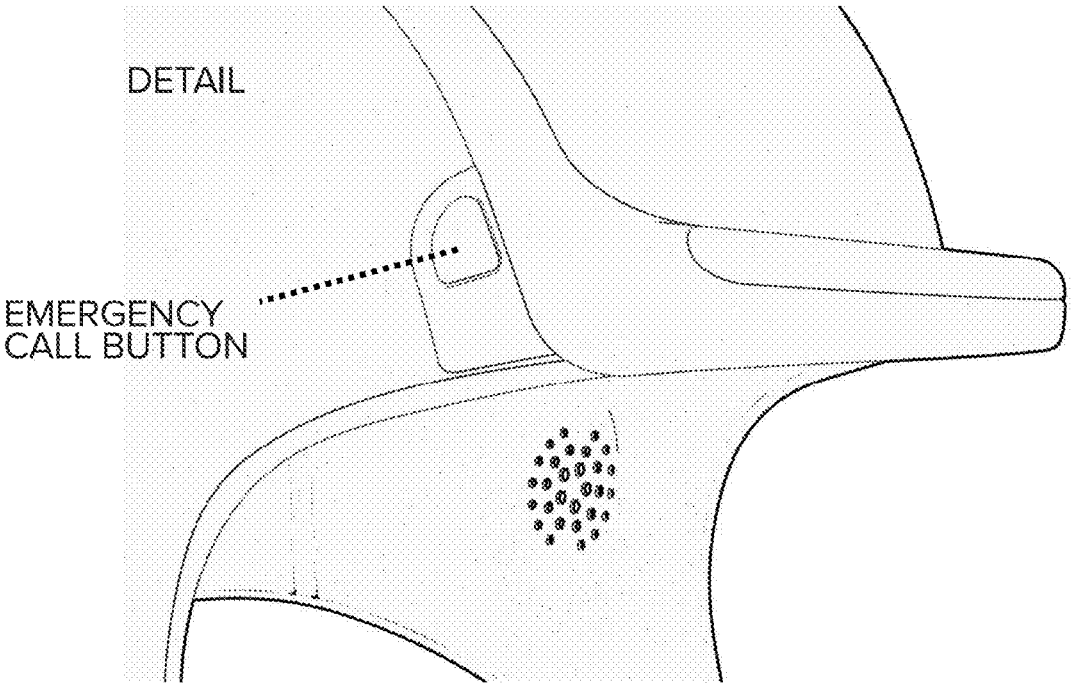
FIG. 8 is a partial detailed view of an emergency call button element for use therewith.
Figure 9:
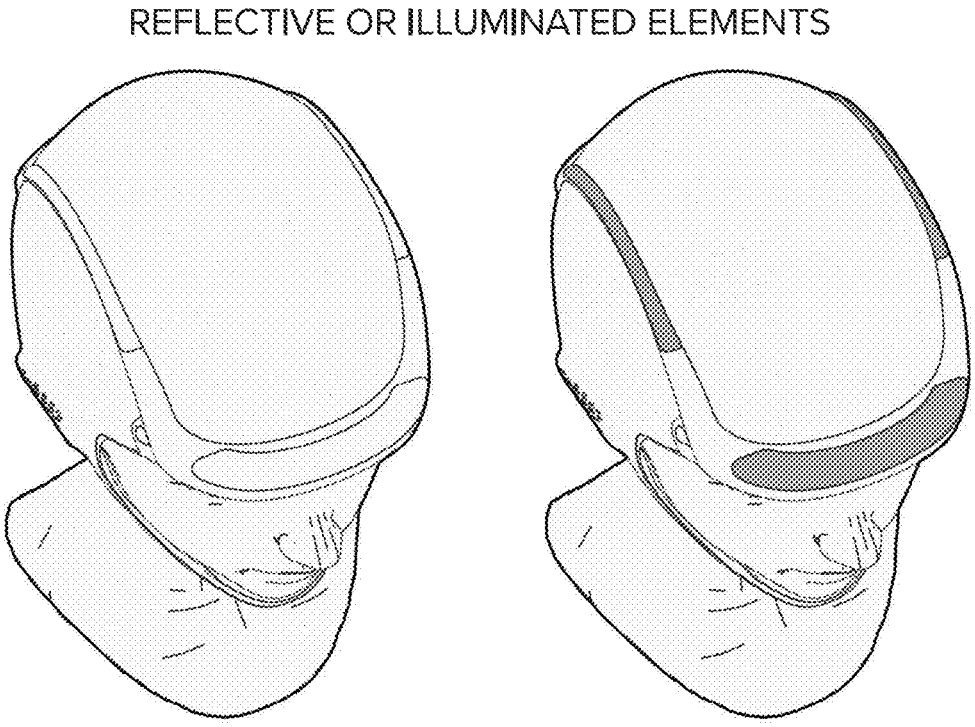
FIG. 9 is a top perspective view showing reflective or illuminated elements for use therewith.
Figure 10:
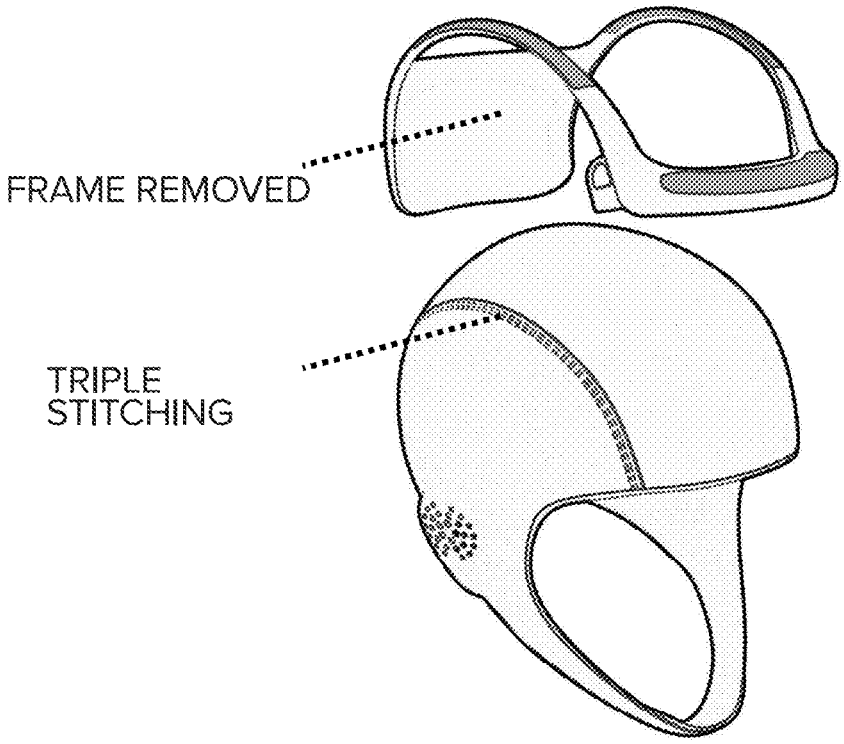
FIG. 10 is an exploded perspective view thereof.

For the alternate preferred embodiment, as shown in FIG. 6-8, the covering unit includes advanced features such as a GPS version with an LED strip positioned along the seams of the central head panel, activated during emergencies to light up and increase wearer visibility. Electronics, including sensors and Bluetooth, are housed within a waterproof case to ensure functionality in wet conditions. An eyebrow visor is incorporated to protect the eyes from water and sunlight, and a battery activator pull is included for activating the GPS and LED features. A technology chassis, made of TPU rubber and flexible enough for manufacturing on a sewing or Bemis machine, forms a molded frame that contains all of the technology, ensuring protection against water damage. The design considers frame seam allowance to follow the contour of the cranium, and visor seam allowance to secure the visor effectively.

The shell component is anticipated to provide insulating properties, with a thickness suited for maintaining the user's head temperature within a euthermic range. An additional insulating component 19, lining the inner surface 12, offers variable thickness to cover different areas of the head, ensuring comprehensive insulation. The covering unit 10 is designed to cover below the midpoint of the external auditory meatus bilaterally, as well as the rear portion of the head and the upper neck region, with a design that ensures direct contact with the head to prevent air gaps and reduce the risk of hypothermia.

It is envisioned that the covering unit 10 will be available in various sizes to accommodate different users efficiently. An adjustment or a take-up mechanism may be utilized to ensure a close fit without undue pressure, and the material used is selected for its non-conductive and potentially fire-retardant properties, enhancing the safety of the device.

In summary, the features of the covering unit 10, across its main embodiment and the alternate preferred embodiment, prioritize user safety, comfort, and visibility, making it a highly effective solution for watercraft passengers and water sports participants.

2. Operation of the Preferred Embodiment

In operation, the present invention the covering unit 10 is anticipated for use in maintaining the head temperature and core body temperature within euthermic range for a user in the event of an accident or emergency while on the water. Anticipated as being used in an operationally nonconflicting manner in conjunction with a U.S. Coast Guard-approved life jacket, the user's head 70 is covered at the forehead, ears and a base having a back portion along a line where the head and neck meet. The covering unit 10 is closely fitted to the head 70 and maintains a close proximity while in the water.

The head covering 10 provides further additional insulation at least a portion of a user's head while being donned. The covering unit 10 is made such as to grippingly engage below the wearer's external auditory meatus bilaterally and conform closely to the user's head.

It is anticipated that the use of the present invention can be used in conjunction with life preservers or life jackets for water or cold weather rescue operations.

The foregoing descriptions of the specific embodiments of the present invention have been presented for the purposes of illustration and description only. They are not intended to be exhaustive nor are they intended to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and their equivalents. Therefore, the scope of the invention is to be limited only by the following claims.

Having thus described the invention, what is claimed as new and desired and to be secured by Letters Patent is as follows:

1. A hypothermia prevention cap for watercraft passengers and water sports participants, the cap being configured for wearing on a wearer's head and comprising:

- a multi-layer shell with an outer layer made of nylon and an inner layer made of 2.5 mm thick neoprene, designed to the wearer's head and minimize open air space;
- flatlock seams with spot glue reinforcement at seam ends for enhanced durability, and forming holes configured to align with ear be positions of the wearer for auditory perception without compromising thermal insulation;
- elastane binding around face and neck edges of the multi-layer shell attached using zigzag stitching for a secure and comfortable fit;

a gripping lower edge to secure the cap on the wearer's head; and a molded frame to contain all technological components and protect them against water damage, designed with a frame seam allowance that follows the contour of the cranium and a visor seam allowance for secure attachment of the visor.

2. The hypothermia prevention cap of claim 1, further comprising a visual target or beacon integrated along the crown of the cap from front to back, wherein the visual target or beacon includes either a light-reflective material or an active lighting element to enhance the wearer's visibility during rescue operations.

3. The hypothermia prevention cap of claim 1, wherein the cap includes a GPS-enabled LED strip positioned along the seams of the central head panel, activated in emergencies to signal the wearer's location.

4. The hypothermia prevention cap of claim 3, wherein the cap includes a battery activator pull for activating the GPS and LED features in emergencies.

5. The hypothermia prevention cap of claim 3, wherein the GPS-enabled LED strip includes a user-activated switch accessible from the exterior of the cap, allowing wearers to activate the emergency signal without removing the cap, thus maintaining thermal insulation and visibility during rescue operations.

6. The hypothermia prevention cap of claim 1, further comprising a waterproof case integrated into the cap to house electronics, including sensors and Bluetooth connectivity, ensuring operational functionality in wet conditions.

7. The hypothermia prevention cap of claim 6, further including an eyebrow visor for protection against water and sunlight, enhancing wearer's comfort and visibility.

8. The hypothermia prevention cap of claim 7, further comprising a removable and adjustable eyebrow visor, allowing users to customize the level of sun and water protection based on user preference.

9. A covering unit as claimed in claim 6, wherein the waterproof case for housing electronics is detachably integrated into the cap, allowing for the electronics to be removed and the cap to be cleaned or serviced without damaging the technological components.

10. A covering unit of claim 1, wherein the shell component's gripping lower edge includes an adjustable mechanism for securely fitting various head sizes and shapes, thereby ensuring that the covering unit remains in place during use.

11. The covering unit of claim 10, wherein the shell component is further characterized by punched holes over the ear positions, each hole being 5×3 mm in size to balance thermal insulation with auditory perception, allowing users to hear rescue signals and communications without compromising the insulative effectiveness of the covering unit.

12. The hypothermia prevention cap of claim 1, wherein the multi-layer shell's outer nylon layer is treated with a water-repellent coating to enhance the waterproof properties of the cap, thereby increasing the wearer's protection against water immersion.

13. The hypothermia prevention of claim 1, wherein the insulative component covering the inner surface comprises a composite layering of a ceramic fiber material, a phase change material, and a synthetic microfiber, offering a customizable approach to thermal regulation based on environmental conditions and wearer needs.

* * * * *